US012110756B2

(12) United States Patent
Laun

(10) Patent No.: US 12,110,756 B2
(45) Date of Patent: Oct. 8, 2024

(54) MODIFIED CEMENT PLUG AND METHODS OF USE

(71) Applicant: Canadian Casing Accessories Inc., Calgary (CA)

(72) Inventor: Lyle Laun, Calgary (CA)

( * ) Notice: Subject to any disclaimer, the term of this patent is extended or adjusted under 35 U.S.C. 154(b) by 0 days.

(21) Appl. No.: 18/070,814

(22) Filed: Nov. 29, 2022

(65) Prior Publication Data

US 2023/0175344 A1 Jun. 8, 2023

Related U.S. Application Data

(60) Provisional application No. 63/286,274, filed on Dec. 6, 2021.

(51) Int. Cl.

| | |
|---|---|
| ***E21B 33/12*** | (2006.01) |
| ***E21B 33/16*** | (2006.01) |
| ***E21B 47/11*** | (2012.01) |
| ***E21B 47/117*** | (2012.01) |

(52) U.S. Cl.
CPC ..... *E21B 33/1208* (2013.01); *E21B 33/16* (2013.01); *E21B 47/117* (2020.05); *E21B 47/11* (2020.05); *E21B 2200/08* (2020.05)

(58) Field of Classification Search
CPC ..... E21B 27/00; E21B 27/02; E21B 33/08; E21B 33/1208; E21B 33/126; E21B 33/16; E21B 33/165; E21B 37/10; E21B 2200/08
See application file for complete search history.

(56) References Cited

U.S. PATENT DOCUMENTS

| | | | | |
|---|---|---|---|---|
| 4,227,573 | A * | 10/1980 | Pearce | E21B 23/10 277/436 |
| 5,544,705 | A * | 8/1996 | Jones | E21B 27/02 166/291 |
| 8,025,102 | B2 * | 9/2011 | Dewar | E21B 27/02 166/387 |
| 10,260,306 | B1 * | 4/2019 | Beckett | E21B 33/124 |
| 11,613,959 | B1 * | 3/2023 | McFarlin | E21B 34/142 166/386 |
| 2009/0200028 | A1 * | 8/2009 | Dewar | E21B 27/02 166/162 |
| 2014/0190685 | A1 * | 7/2014 | Frazier | E21B 33/129 166/135 |
| 2017/0247988 | A1 * | 8/2017 | Hardesty | E21B 43/11852 |
| 2017/0247996 | A1 * | 8/2017 | Hardesty | E21B 33/1208 |
| 2018/0045014 | A1 * | 2/2018 | Larisey | E21B 37/10 |
| 2018/0112488 | A1 * | 4/2018 | Budde | E21B 23/01 |
| 2019/0186228 | A1 * | 6/2019 | Beckett | E21B 33/16 |

(Continued)

FOREIGN PATENT DOCUMENTS

| | | | | |
|---|---|---|---|---|
| SU | 1190003 | A1 * | 11/1985 | E21B 33/16 |

*Primary Examiner* — Jennifer H Gay
(74) *Attorney, Agent, or Firm* — Russell Manning, FisherBroyles, LLP

(57) ABSTRACT

An improved wiper plug and methods of using the plug during casing and cementing operations within a subterranean wellbore are provided. The present plugs may preloaded with at least one engineered material and operative to release the material over time at a target location within the wellbore, such release serving to enhance the degradation of dissolvable components within the plugs and/or within the casing string, and/or to alter the chemical properties of the wellbore environment.

19 Claims, 3 Drawing Sheets

(56) References Cited

U.S. PATENT DOCUMENTS

| | | | | |
|---|---|---|---|---|
| 2020/0173252 | A1* | 6/2020 | Lende | E21B 33/16 |
| 2022/0220821 | A1* | 7/2022 | Budde | E21B 33/16 |
| 2022/0228461 | A1* | 7/2022 | Sims | E21B 34/063 |
| 2023/0175344 | A1* | 6/2023 | Laun | E21B 33/16<br>166/250.12 |

* cited by examiner

MODIFIED CEMENT PLUG AND METHODS OF USE

CROSS-REFERENCE TO RELATED APPLICATION

This application claims benefit of priority to U.S. Provisional Patent Application No. 63/286,274 entitled "MODIFIED CEMENT PLUG AND METHODS OF USE" and filed Dec. 6, 2021, which is specifically incorporated by reference herein for all that it discloses or teaches.

FIELD

Embodiments herein are generally related to apparatus for use in the oil and gas industry, and more particularly to downhole plugs, such as cement plugs, that can also concurrently be used as pressure-testing tools and to alter fluid chemistries downhole.

BACKGROUND

During the drilling of a wellbore into a subterranean hydrocarbon formation, it is desirable to stabilize the wellbore by introducing multiple layers of steel pipe or 'casing' of varying diameters downhole, the outermost to innermost layers of casing known as conductor casing, surface casing, intermediate casing, and production casing, respectively.

Casing can be joined end-to-end and run downhole as 'casing string' to different depths depending on its function. For example, the outermost conductor casing typically extends from the surface to a predetermined first 'casing point' to protect the loose near-surface formation. Surface casing extends past the conductor casing point to provide both pressure integrity and structural strength, such that intermediate and/or production casing strings can be suspended therefrom further into the formation. Depending on various parameters, one or more intermediate and/or production casing strings may be installed from the surface casing all the way to the production zone.

In order to stabilize the wellbore, each casing string must be cemented in place. Cementing procedures involve pumping a cement slurry through the inside and out from the bottom of each casing until it circulates up into the annulus, forming a cement sheath around the casing. Prior to introducing the cement slurry into the casing, the casing may contain drilling mud or other servicing fluids that could contaminate the cement slurry. To prevent this contamination, one or more cementing plugs, known as 'bottom plugs', can be introduced into the casing ahead of the cement slurry to displace any mud or fluids from within the casing and to form a barrier preventing comingling of the slurry with the fluids.

Once the cement slurry has been pumped through the casing and into the annular space between the casing and the wellbore, displacement fluids are used to clean any residual cement from the casing. To prevent contamination of the cement slurry by such displacement fluids, however, one or more additional cement plugs, known as 'top plugs' are introduced into the casing ahead of the fluids to displace any cement from within the casing and to form a barrier preventing comingling of the fluids with the slurry while it sets. Once in the annular space, the cement slurry sets to form an annular sheath of hardened, substantially impermeable cement that bonds and stabilizes the casing string to the wellbore.

Top cement plugs are commonly pumped down the casing string until they land and engage into a float valve or float collar positioned above a landing collar at the toe of the wellbore. In this manner, top plugs not only serve to wipe cement slurry from the inner surface of the casing, but they also block cement from returning or U-tubing back into the casing string. This requires top plugs to remain in place within the casing string until the cement sets, a process that can take several hours. Moreover, this also requires top plugs to be sufficiently secure and robust to withstand pressure testing of the casing string, a process that can involve significantly increasing fluid pressures within the casing (above the plug). Problems arise, however, when the fluid flow path through the casing needs to be reinstated and the plugs need to be removed.

In some cases, top plug(s) positioned within a casing string can be removed by rupturing a portion of the plug, allowing fluid to pass through the plug. Such plugs, however, are often insufficient to withstand the substantial pressure increases required during pressure testing to ensure the integrity of both the casing strings and cement sheaths, leading to premature or inadvertent rupture of the plugs. Moreover, the ruptured materials can create debris within the annulus of the casing string that becomes lodged downhole (e.g., between the drill bit and the motor), increasing completion time and costs. As a result, top plug(s) having rupture or burstable componentry are not typically suitable for use in cementing operations.

In some cases, top plug(s) positioned within a casing string can be removed by completely or nearly-completely milling out the plug (e.g., using specialized drilling equipment, including polycrystalline diamond compact, or 'PDC', bits). Such plugs, however, can be difficult to mill out, particularly where the plug inadvertently rotates within its seat, rendering the mill ineffective.

Many attempts have been to overcome these problems, including the research of development of improved plug designs. In some cases, improved plugs have been designed to comprise dissolvable componentry that, initially, are of sufficient strength and durability to maintain the plug in place within the casing string during pressure testing, but then, subsequently, are degradable or dissolvable so that drill-out or other plug removal techniques can be carried out in a time-saving manner. For example, some plugs have been manufactured with dissolvable elements including 'slips' that are comprised of dissolvable metallic or acid polymer elements. Such plugs, however, still suffer from significant setbacks including the need for wireline deployment, requiring plugs to be equipped with a coupling for securing the wireline. Such plugs can also require careful calculation and control of downhole fluid chemistries (e.g., chlorides), which may not be accurate or known, to prevent premature or untimely dissolution of the dissolvable componentry. Indeed, drilling muds can have specific fluid chemistry requirements that are not typically well suited for use with dissolvable materials. Worse, where dissolution of dissolvable componentry is inaccurate or uncontrolled, trapped fluids could result in a safety hazard (e.g., trapped brine within a closed volume can generate hydrogen gas, increasing pressure and temperature). These problems are further exacerbated when the dissolvable materials are found deep within the wellbore.

Moreover, as with plugs having rupture or burst disks, dissolvable cement plugs are not typically capable of withstanding standard pressure testing that is performed to ensure the integrity of both the casing strings and cement sheaths. For example, industry regulations require that each casing string and corresponding cement sheath be tested to meet strict requirements for compression, tension, collapse, as well as for burst resistance, quality, and consistency. These pressure integrity tests are typically performed by first isolating the string with specialized pressure-test plugs, and then pumping fluids downhole to gradually increase the pressure within the string. The specialized plugs used during pressure tests must be durable enough to obstruct the borehole while holding fluid pressures both above and below the plug, but still malleable enough to be milled out to restore the casing borehole when the testing is complete.

There remains a need for improved downhole plugs that can be used to prevent fluid flow through a casing string during pressure testing and that can then be readily removed from the casing string to reinstate fluid flow through the casing. It is desirable that such improved downhole plugs to be capable of controllably delivering specific volumes of engineered materials (e.g., catalytic fluids) preloaded into the plugs to target locations within the casing string, such fluids used to trigger the dissolution of dissolvable equipment and/or to alter the fluid chemistries in the downhole environment.

SUMMARY

According to embodiments, an improved cementing plug for use in wiping the inner surface of a casing string positioned within a subterranean wellbore is provided. In some embodiments, the plug may comprise at least one tubular body forming a longitudinal bore extending therethrough, the longitudinal bore being temporarily sealed by at least one dissolvable disc to form a chamber for receiving and containing at least one engineered material. In some embodiments, the plug may further comprise at least one annular wiper fin mounted to the tubular body and extending radially outwardly therefrom to engage the inner surface of the casing string.

In some embodiments, the plug may comprise at least one tubular body formed from at least two tubulars forming the sealed chamber within the longitudinal bore. In such embodiments, at least one of the two tubulars may comprise the dissolvable disc. The dissolvable disc may be manufactured from a degradable metal alloy.

In some embodiments, the at least one engineered material comprises a catalytic material for enhancing the degradation of the dissolvable disc.

In some embodiments, the plug may comprise at least one tubular body formed from at least three tubulars forming the sealed chamber within the longitudinal bore. In such embodiments, one of the at least three tubulars further may comprise at least one lid temporarily secured thereto. The at least one lid may be manufactured from elastomeric materials, dissolvable materials, or a combination thereof. The at least one lid may be manufactured from thin, solid or nearly solid, pliable synthetic materials such as a synthetic vinyl, including polyvinyl alcohol (PVA) plastic, a thermoplastic polymer, polyglycolide or poly(glycolic acid) PGA, or the like, from one or more elastomeric materials, and/or a combination thereof.

In some embodiments, the at least one wiper fin is formed from at least two fin materials. The at least two fin materials comprise at least one elastomeric material, at least one dissolvable material, or a combination thereof.

According to embodiments, a method of delivering at least one engineered material to a target location in a casing string positioned in a subterranean wellbore is provided. In some embodiments, the method may comprise providing at least one wiper plug having a body forming a longitudinal bore, the longitudinal bore forming at least one chamber for receiving and containing the at least one engineered material, and at least one dissolvable disc loading the chamber of the at least one wiper plug with the at least one engineered material, launching the at least one wiper plug into the casing string and allowing the wiper plug to wipe the casing string as it passes therethrough, landing and securing the wiper plug at or near the target location, and allowing the at least one engineered material to degrade the at least one dissolvable disc and controllably release the at least one engineered material into the wellbore.

In some embodiments, the at least one engineered material is a catalytic material for enhancing the degradation of the at least one dissolvable disc.

In some embodiments, the release of the at least one engineered material occurs at a predetermined time and a predetermined rate.

In some embodiments, the release of the at least one engineered material further controllably alters the chemical properties of fluids in the wellbore.

In some embodiments, the release of the at least one engineered material further controllably degrades at least one dissolvable component positioned within the wellbore.

In some embodiments, prior to the release of the at least one engineered material, integrity testing of the casing string is performed.

In some embodiments, wherein gases produced from the degradation of the at least one dissolvable disc may controllably vented from the at least one wiper plug.

In some embodiments, the at least one wiper plug may further be loaded with at least one tracer material.

DETAILED DESCRIPTION OF THE PREFERRED EMBODIMENTS

Figure 1A:
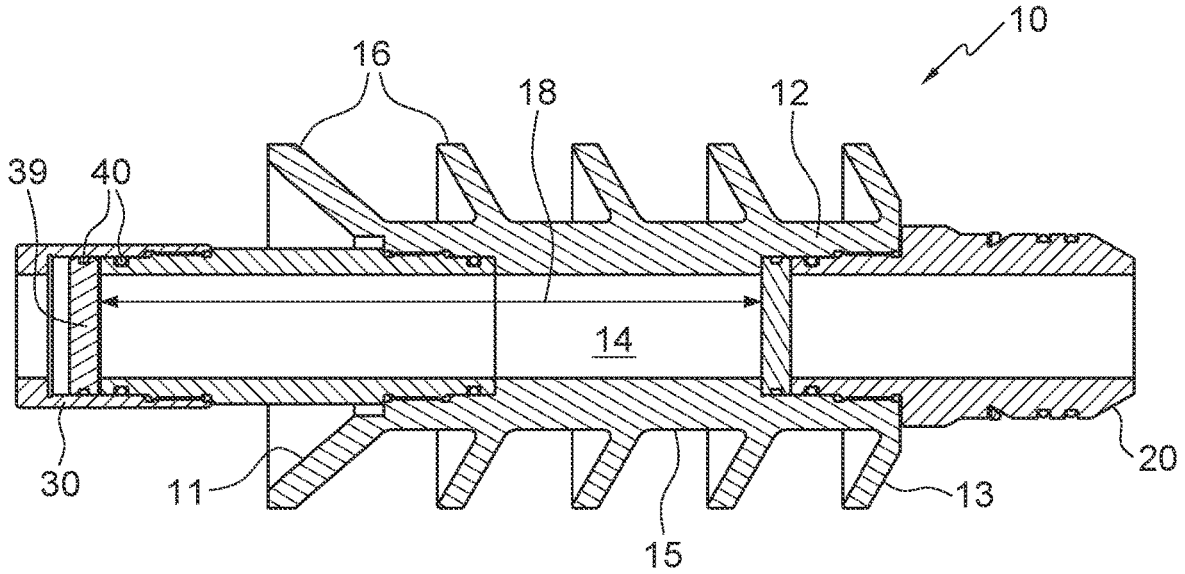
FIG. 1A shows a cross section side view of an improved cementing plug, according to embodiments.

According to embodiments, an improved wiper plug and methods of using the plug in a subterranean wellbore are provided. In some embodiments, one or more of the presently improved wiper plug(s) may be introduced into the wellbore during the casing operations, particularly where integrity testing is being performed. In other embodiments, one or more of the presently improved wiper plug(s) may be introduced into the wellbore during or after cementing operations, particularly where it is desired to easily and controllably reinstate fluid flow through the toe of the wellbore after cementing is complete. Although the presently improved wiper plug(s) are described for use during casing and/or cementing operations, such description is for explanatory purposes only and it is contemplated that any other suitable downhole use of the plugs is contemplated (e.g., bridge plugs, frac plugs, packers, etc.).

According to embodiments, an improved wiper plug and methods of using the plug to controllably alter the fluid chemistries at targeted locations within a subterranean wellbore are provided. In some embodiments, one or more of the presently improved wiper plug(s) may be configured to receive and contain a quantity of at least one engineered material (e.g., catalytic materials) and then may be introduced into the wellbore to land at a plurality of predetermined target locations within the subterranean wellbore. In some embodiments, one or more of the presently improved wiper plug(s) may be configured to receive and contain a quantity of at least one engineered material (e.g., catalytic materials) and then may be introduced into the wellbore to deliver the material via controlled, delayed release at the predetermined target locations within the subterranean wellbore. In such embodiments, the engineered materials may serve as a trigger to reliably initiate the dissolution of specific dissolvable downhole components.

Herein, the following terms are used for explanatory purposes and are not intended to limit or alter the actual componentry or implementation of the present apparatus and methods of use. The terms "above/below" and "upper/lower" are used for ease of understanding and are generally intended to mean the relative uphole and downhole from surface. The term "uphole" is intended to mean along the casing string or the wellbore towards the surface and the term "downhole" is intended to mean along the casing string or wellbore from the surface towards the toe of the wellbore end. The term "upstream" is intended to mean along a flow path towards the source of flow, and the term "downstream" is intended to mean along a flow path away from the source of the flow.

The terms "engineered materials/fluids", "catalytic materials/fluids", and "reactive materials/fluids" are used for ease of understanding and are generally intended to define an effective amount or quantity of substance operative to alter (i.e., increase or decrease) the concentration of dissolved solutes in a solvent, such as dissolved salts in water. In other words, engineered, catalytic, and/or reactive materials are used herein to refer to any substance operative to change the salinity of the wellbore environment. In some embodiments, engineered materials may mean a substance comprising a high concentration of chloride ions, the substance being in any suitable form including, without limitation, dry salt, salt contained in a PVA bag, or in a sugar or starch pellet. Where applicable, the engineered materials may take any size, shape, or formulation suitable for transporting the chloride ions including, without limitation, a powder, a paste, a rod, or a tablet. Although changes in the salinity of wellbore fluids is described herein to achieve the desired dissolution results (as will be described), it should be understood that any other materials and/or fluids serving to alter the properties of wellbore fluids for the presently described purposes are contemplated.

The term "about" is provided herein may be provided as a means for modifying a term or parameter herein, the term or parameters relating to, without limitation, ranges, limits, quantities, reaction conditions, and so forth. As used herein, the term "about' might encompass+/−n % of each numerical value. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

The improved cement plug will now be discussed having regard to FIGS. 1-3.

Figure 1B:
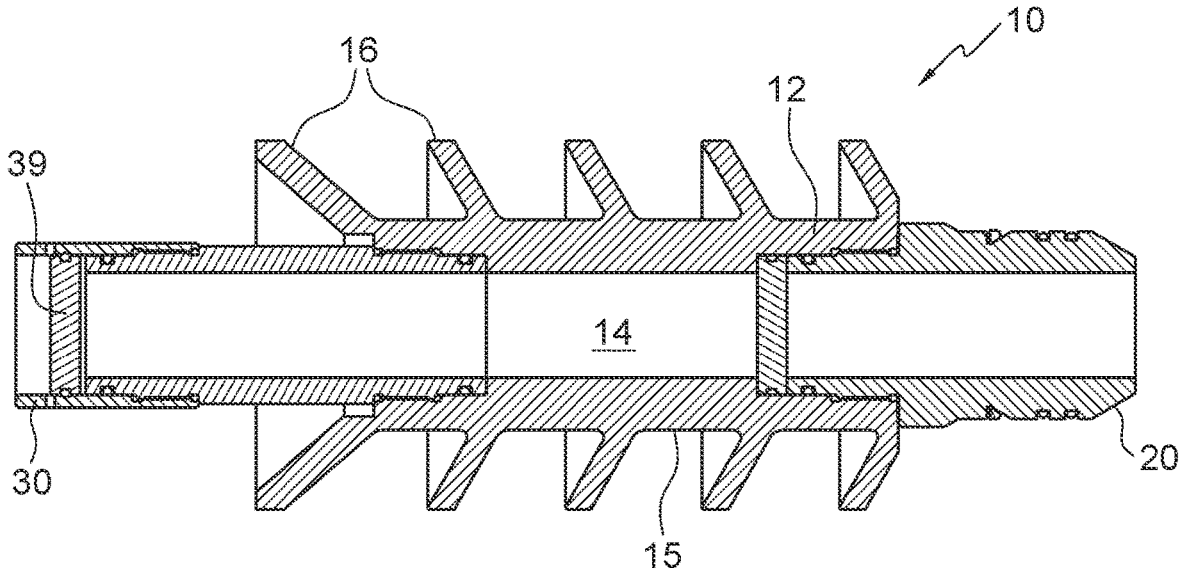
FIG. 1B shows a cross section side view of the cementing plug of FIG. 1A, the plug having an alternative end cap configuration, according to embodiments.

Having regard to FIGS. 1A and 1B, a presently improved wiper plug 10, also referred to as a cement or cementing plug, is provided and configured to be launched into a subterranean wellbore, the wellbore being lined with at least one casing string, production tubing, liners, or a combination thereof. Plugs 10 may be used to separate and isolate cement slurry from other fluids in the wellbore during operations for cementing the casing string. As will be appreciated, plug 12 may be designed for launch or deployment down the casing string relative to a downhole direction of movement of plug through the casing string (not shown).

In some embodiments, plug 10 may comprise a substantially hollow cylindrical tubular body 12. Plug body 12 may have an uphole 'tailing' end 11 and a downhole leading 'nose' end 13. Plug body 12 may form an elongate central bore 14 extending longitudinally therethrough and have an outer surface 15 with a substantially circular cross-section. In some embodiments, plug body 12 may be sized and shaped so as to be slidably received within the casing string, and such that central bore 14 may be in fluid communication with the casing string annulus.

In some embodiments, plug body 12 may comprise at least one rigid tubular. In other embodiments, plug body 12 may comprise at least two rigid tubulars. For example, plug body 12 may be configured for operable connection with at least one nose portion 20, such operable connection being end-to-end threadable engagement, i.e., via box-and-pin joint, or any other means for operable connection known in the art. In some embodiments, plug body 12 may comprise at least three rigid tubulars. For example, plug body 12 may be configured for operable connection with at least one end cap 30, such operable connection being end-to-end threadable engagement, i.e., via box-and-pin joint, or any other means for operable connection known in the art. In such embodiments, downhole end 13 of plug body 12 may be operably connected to a nose portion 20 and uphole end 11 of plug body 12 may be operably connected to an end cap 30. In this manner, as will be described, plug body 12 may form an enclosed central bore 14. When sealed at its downhole end by nose cap 20 and at its uphole end by end cap 30, bore 14 may form enclosed chamber 18 for receiving and containing an engineered material.

More specifically, in some embodiments, when plug 10 is configured to obstruct fluid flow through the casing string (i.e., in a first 'closed' embodiment, shown in FIGS. 1A and 1B), bore 14 may be closed off to form a sealed chamber (between arrows 18, FIG. 1A). Such embodiments enable plug(s) 10 to be pumped downhole serving as wiper plugs during cementing operations. Such embodiments enable plug(s) 10 to securely land at or near a target location and optionally latch with downhole componentry serving to isolate sections of the casing string such that integrity testing of the casing string and/or cement sheath can be performed. Such embodiments allow plug(s) 10, pre-loaded with at least one engineered material in chamber 18, to controllably release the engineered material at the target location serving to degrade dissolvable componentry in the plug(s), dissolvable componentry positioned downhole, and/or to controllably alter the wellbore fluid chemistries, as desired. For example, plug(s) 10 may be configured to be doped with at least one engineered material(s) operable to controllably enhance the degradation of specific dissolvable componentry within the plug (e.g., dissolvable discs), of specific dissolvable componentry positioned within the wellbore (e.g., for the dissolution of componentry at or near where plug 10 lands including, without limitation, check valves and other componentry in the shoe track). In such embodiments, plug(s) 10 may be configured to be doped with at least one engineered material(s), e.g., a catalytic substance, for controllably altering wellbore fluid chemistries (e.g., salinity) at predetermined, target locations within the wellbore during or after casing and cementing operations.

Figure 2:
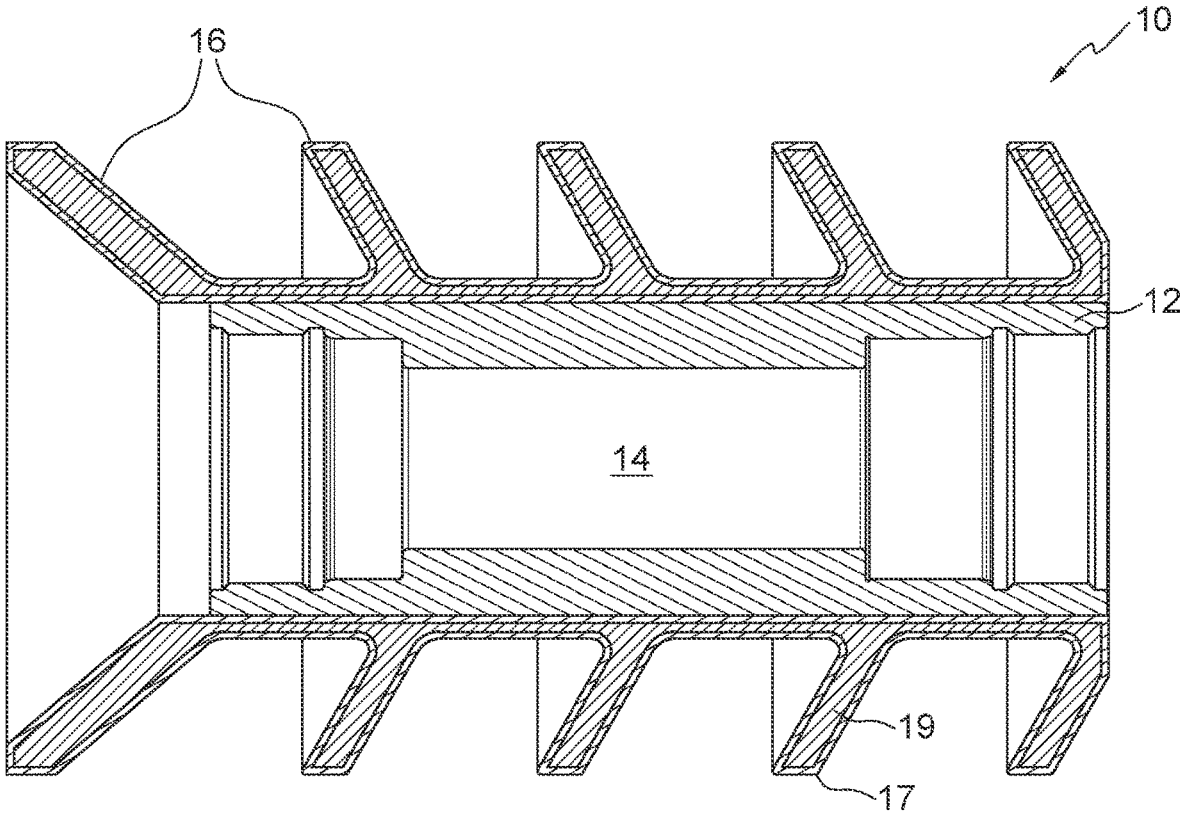
FIG. 2 shows a zoomed-in cross section side view of the cementing plug showing in FIG. 1, according to embodiments.

According to further embodiments, once in position within the wellbore, plug 10 may, over time, be configured to allow fluid flow through the plug body 12, and thus through the casing string annulus, (i.e., in a second 'open' embodiment, FIG. 2). In such embodiments, bore 14 may open to form a fluid flow passageway through plug 10 to the wellbore down below. That is, removal of dissolvable or other obstructions within plug 10 (i.e., and opening of chamber 18), can be controllably triggered if and when it is desirable to allow fluids to flow through plug 10.

According to embodiments, about its outer surface, tubular plug body 12 may support at least one annular wiper element(s) or fin(s) 16 mounted thereto, fins 16 extending completely circumferentially around body 12. Fins 16 may be configured to extend radially from, and be spaced along the length of, outer surface 15 so as to slidingly engage against the inner surface of the casing string. That is, when in a relaxed state, fins 16 may extend to an outer radius that is substantially greater than the inner radius of the casing. Then, when inserted into the casing string, fins 16 may flex such that fins 16 are biased into sealing engagement with the inner surface of the casing. In this manner, as the plug 10 advances through the casing, the outer (distal) ends of the fins 16 engage with and wipe the inner surface of the casing string, while preventing fluids from undesirably passing thereby and comingling with other fluids in the casing.

According to embodiments, fins 16 may be manufactured from at least one durable resilient material capable of flexing into biased sealing engagement with the inner wall of the casing, and then also capable of being easily removed from the casing string when and as desired (i.e., restoring or nearly restoring the inner diameter of the casing string annulus).

In some embodiments, fins 16 may be manufactured from at least two materials. For example, fins 16 may be manufactured from at least one material comprising a rigid, dissolvable material, from at least one flexible, elastomeric material, and/or a combination thereof. Any suitable flexible elastomeric material capable of enduring abrasive and frictional wear is contemplated including, without limitation, rubber, urethan rubber, nitrile, silicon or the like. Any suitable durable, yet pliable, dissolvable or semi-dissolvable material is contemplated including, without limitation, a solid or nearly solid, pliable synthetic material such as a synthetic vinyl, including polyvinyl alcohol (PVA) plastic, a thermoplastic polymer, polyglycolide or poly(glycolic acid) PGA, or the like. At least a portion of fin 16 may be manufactured using additive processes (e.g., 3D printing, or the like), providing flexibility in both the structure and function of plug 10 and its components. For example, without limitation, it is contemplated that at least a portion of fins 16 may be manufactured using a honeycomb PVA structure, or other suitable structure, for optimizing contact pressure versus deflection between the at least one fin 16 and the inner surface of the casing string annulus.

For example, having regard to FIG. 2, at least one of the first two materials may for an elastomeric outer shell or skin 17 for sealingly engaging with (and wiping) the inner surface of the casing string, while at least a second one of the at least two materials may form a rigid, dissolvable inner core 19 encapsulated therein. Accordingly, when it desired to mill plug 10 from the casing string annulus, the outer skin 17 of plug 10 may comprise less elastomeric material to be torn/milled, such reduced material being more easily broken into fragments and resulting in less debris to be circulated out of the wellbore. Further, once broken down, remnant outer skin 17 material (if any) may be of insufficient size and volume to obstruct the casing string annulus (between the motor or mill and the inner diameter of the casing string) and/or to clog any downhole equipment, i.e., less elastomeric material 17 can minimize the risk of fluid flow disruption/restriction through the casing string. As the elastomeric material 17 is milled, inner core 19 becomes exposed to fluids within the casing string (e.g., exposing the PVA portion of fins 16 to water) triggering core 19 to dissolve. Although fins 16 are shown having a first outer shell 17 enveloping inner dissolvable core 19, such depiction is for explanatory purposes only and any other suitable configuration that achieves the object of the invention is contemplated.

According to embodiments, as above, plug(s) 10 may be configured to comprise at least two tubulars operably connected end-to-end. In some embodiments, a first one of the two tubulars may comprise plug body 12, and at least a second one of the two tubulars may comprise nose portion 20. Having regard to FIG. 3A, nose portion 20 may be sealably connected to plug body 12, e.g., via threaded box-and-pin connection at downhole or 'leading' end 13 of plug body 12. In some embodiments, nose portion 20 may comprise a substantially hollow cylindrical tubular body 22. Nose portion 20 may have an uphole 'tailing' end 21 and a downhole 'leading' end 23. At its uphole end 21, at least a portion of nose portion 20 may be received by and shouldered within central bore 14. Nose portion 20 may form an elongate central bore 24 extending longitudinally therethrough and have an outer surface 25 with a substantially circular cross-section. Fluid bore 24 may be axially aligned, and in fluid communication with, central plug bore 14 (and the casing string annulus).

Figure 3A:
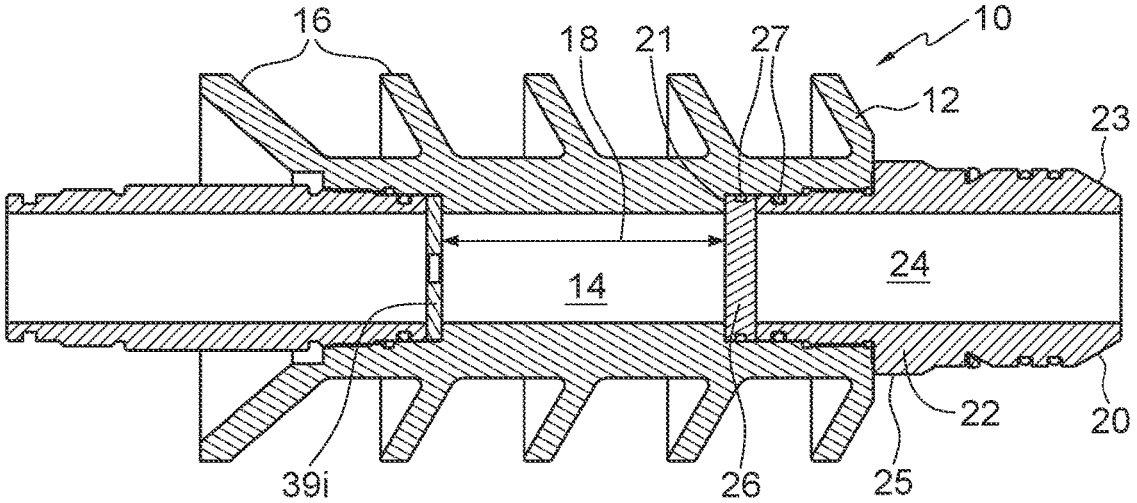
FIG. 3A shows a cross section side view of the cementing plug shown in FIG. 1, the plug having an alternative end cap configuration, according to embodiments.
Figure 3B:
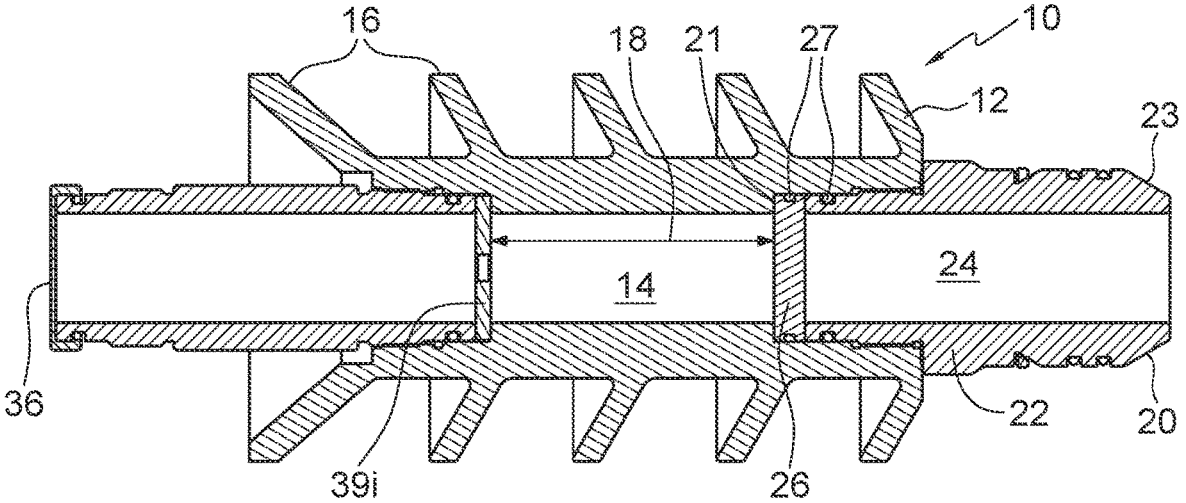
FIG. 3B shows a cross section side view of the cementing plug shown in FIG. 1, the plug having yet a further end cap configuration comprising a flexible lid, according to embodiments.

According to embodiments, having regard to FIG. 3B, nose portion 20 may be configured to temporarily block or obstruct fluid flow through central nose bore 24, and correspondingly through plug bore 14 and the annulus of the casing string. In this manner, plug 10 may be operable as a wiper plug during casing and/or cementing operations, and further operable to isolate sections of the casing string for integrity testing thereof. Moreover, in this manner, plug 10 may form a sealed chamber 18 for receiving and containing engineered materials loaded therein and serve to deliver and release such materials at a target location downhole (as will be described).

In some embodiments, nose portion 20 may comprise at least one dissolvable or partially dissolvable element positioned within central nose bore 24, such as disc 26. Disc 26 may be positioned at or near uphole end 21 of nose portion 20, or in any other manner such that the dissolvable element is positioned proximal to downhole end 13 of plug body 12.

In some embodiments, disc 26 may be substantially circular in cross section and have an outer diameter for sealingly engaging with the inner surface of plug bore 24. When in position, disc 26 may prevent fluid from flowing through plug 10 (and thus the annulus of the casing string) by obstructing fluid flow through bores 14, 24. Outer surface 25 may form at least one annular seal groove for receiving and containing at least one seal 27 (e.g., O-rings). Disc 26 may be manufactured from any suitable materials known in the art and may be securely positioned within nose portion 20, and between bores 14, 24, so as to temporarily prevent fluid flow therethrough. It is contemplated that dissolvable portion 26 may be manufactured from any suitable materials known in the art.

According to embodiments, disc 26 may be configured to form a temporary isolation barrier, operative to isolate an uphole fluid-filled section of the casing string (e.g., during integrity testing of the casing string) from downhole componentry. Disc 26 may be configured to remain in place for a sufficient duration to withstand integrity testing pressures before controllably dissolving to restore the internal diameter of the casing string (i.e., at or near the time that integrity testing is complete). In this manner, without limitation, plug(s) 10 may be configured for use as top plugs during casing and cementing operations. For example, plug(s) may operably be configured for landing in and optionally latching to a float valve or float collar positioned above a landing collar at the toe of the wellbore.

According to embodiments, at least a portion of disc 26 may be manufactured from any suitable dissolvable or degradable materials according to fluid chemistries, fluid volumes, and other subterranean wellbore parameters that might arise during well construction (e.g., swelling clays, precipitates, etc.), as well as any other fluid compatibility issues. In some embodiments, without limitation, some or all the degradable material may comprise a degradable metal alloy, such as a magnesium alloy, or any other such material that is degradable in the presence of water and chlorides. It is understood that such reactions may result in pressure and/or temperature increases, i.e., due to the production of hydrogen gas.

The composition and concentration of the at least one engineered material may be determined based upon identified wellbore fluid chemistries such that a sufficient concentration of ions (e.g., chloride ions) for effectively reacting with dissolvable materials (e.g., magnesium alloys). Advantageously, engineered materials may be specifically designed to overcome any fluid incompatibility issues (e.g., incompatibility with drilling muds, cement slurries, and/or displacement fluids). Such engineered materials may also be designed with an understanding as to the time and rate of the dissolution process, as well as the resulting changes to the chemical properties of the wellbore fluids (e.g., altering the salinity thereof).

In some embodiments, without limitation, some or all the degradable material(s) may be selected according to a specified chemical reaction triggering the timed dissolution of disc 26 upon the occurrence of the reaction. For example, at least a portion of disc 26 may be manufactured from materials that degrade when exposed to wellbore fluids, such as a magnesium alloy that degrades when exposed to water. At least a portion of disc 26 may be manufactured from materials that, when exposed to a catalytic substance (e.g., high chloride concentration solutions, brine, and the like), may enhance the degradation of the materials, such as magnesium alloy being exposed to water and enhanced with exposure to brine. In this manner, advantageously, at least a portion of disc 26 may be manufactured so as to controllably dissolve in a timed manner, such degradation being optionally enhanced using catalytic materials, to open nose bore 24 and plug bore 14 and restore fluid flow through plug 10. In some embodiments, the at least one engineered materials may form a solid or near-solid material having a high concentration of chloride ions, such as a salt pellet. Without limitation, such salt pellets may comprise a minimum salt concentration of about 0.1% (e.g., or any other such suitable concentration as may be determined based upon industry conventions, or when using commercially available Solu-Mag® Freshwater Magnesium Alloys).

According to embodiments, as above, plug(s) 10 may be configured to comprise at least two tubulars operably connected end-to-end. In some embodiments, a first one of the at least two tubulars may comprise plug body 12, a second one of the at least two tubulars may comprise nose portion 20, and a third one of the at least two tubulars may comprise end cap 30. End cap 30 may be sealably connected to plug body 12, e.g., via threaded box-and-pin connection at uphole or 'tailing' end 11 of plug body 12. In some embodiments, end cap 30 may comprise a substantially hollow cylindrical tubular body 32.

Figure 3C:
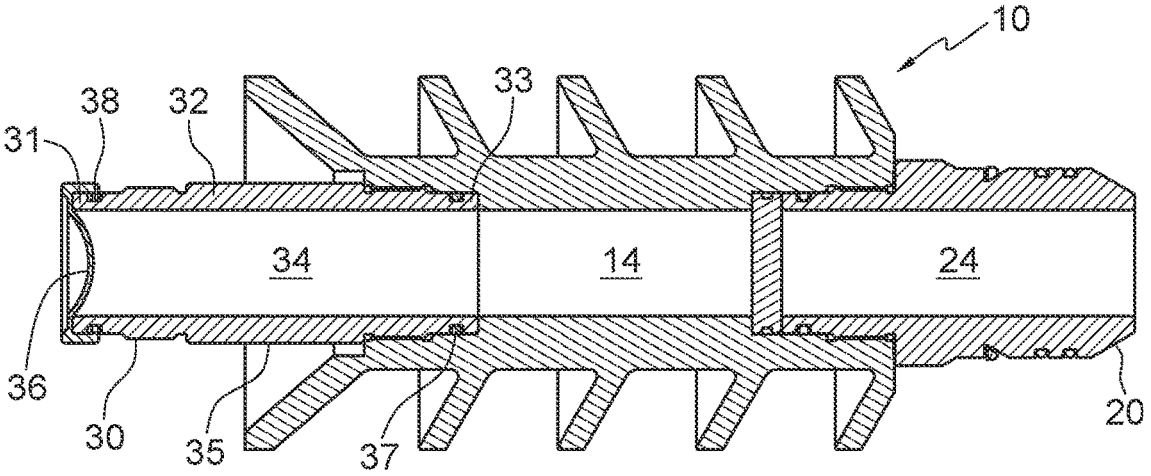
FIG. 3C shows a cross section side view of the cementing plug shown in FIG. 3B, the end cap being shown in an inverted, concave configuration, according to embodiments.

Having regard to FIG. 3C, end cap 30 may have an uphole 'tailing' end 31 and a downhole 'leading' end 33. At its downhole end 33, at least a portion of end cap 30 may form an elongate central bore 34 extending longitudinally therethrough and have an outer surface 35 with a substantially circular cross-section. End cap bore 34 may be axially aligned, and in fluid communication with, central plug bore 14 and nose portion bore 24 (and the casing string annulus).

According to embodiments, end cap 30 may be configured to temporarily block or obstruct fluid flow through central bore 14 of plug 10, and correspondingly the annulus of the casing string. In this manner, as will be described, when plug bore 14 is obstructed, it may form a sealed chamber 18 for receiving and containing engineered materials loaded therein.

In some embodiments, end cap 30 may comprise at least one lid 36 releasably secured thereto. Lid 36 may be positioned at or near uphole 'tailing' end 31 of end cap 30, or in any other manner such that lid 36 is releasably secured to end cap 30 (e.g., see FIGS. 1A and 1B, described in more detail below).

Having regard to FIG. 3C, in some embodiments, lid 36 may be substantially circular in cross section and have an outer diameter for sealingly engaging with outer surface 35 of end cap 30. When in position, lid 36 may prevent fluid from flowing through plug 10 (and thus the annulus of the casing string) by obstructing fluid flow through bores 34, 14, 24, respectively. Outer surface 35 may form at least one annular seal groove for receiving and containing at least one seal 37 (e.g., O-rings). In some embodiments, outer surface 35 may further form at least one annular lid groove 38 for receiving and containing lid 36 via, for example, snap-fit engagement. Lid may be manufactured from any suitable materials known in the art and may be securely positioned over uphole end 31 of end cap 30 so as to temporarily prevent fluid flow therethrough.

According to embodiments, at least a portion of lid 36 may be manufactured from any suitable flexible, burst or rupture materials appropriately responsive to pressure increases that might be controllably generated by one or more chemical reactions occurring within plug bore 24. For example, lid 36 may be configured to remain in snap-fit, sealed engagement with end cap 30 until a threshold pressure increase generated within plug 20 causes lid 36 to rupture or burst from position, e.g., where sufficient hydrogen gas resulting from the degradation of disc 26 and/or other downhole causes a pressure increase within plug bore 24 that releases lid 36 from its sealed engagement with end cap 30. In some embodiments, without limitation, at least a portion of lid 36 may be manufactured from thin, solid or nearly solid, pliable synthetic materials such as a synthetic vinyl, including polyvinyl alcohol (PVA) plastic, a thermoplastic polymer, polyglycolide or poly(glycolic acid) PGA, or the like, from one or more elastomeric materials, and/or a combination thereof.

According to embodiments, lid 36 may be manufactured for quick and easy release from end cap 30. Lid 36 may be specifically designed to release from snap-fit engagement with end cap 30 upon the occurrence of a predetermined pressure increase within end cap bore 34 (relative to pressures within the casing string annulus uphole of lid 36). For example, lid 36 may be releasably secured to end cap 30 such that lid 36 may rupture, burst, or pop-off of groove 38 of cap 30 when a certain pressure differential occurs across lid 36 (e.g., when pressures within bore 34 increases by approximately 50-100 psi). In this manner, lid 36 may be operative as a burst disc, where the burst event can indicate the occurrence and progression of a chemical reaction within plug bore 24 (e.g., without limitation, the degradation of dissolvable materials).

According to embodiments, lid 36 may be configured to ensure that plug 10 does not overpressure and burst inadvertently, minimizing the risk of a health and safety incident. Lid 36 may be manufactured as a flexible membrane capable of absorbing and accommodating pressure and/or temperature increases within plug bore 14. For example, having regard to FIG. 3B, lid 36 may be capable of flexing substantially inwardly (forming a concave dome), substantially outwardly, or in any other to achieve and maintain pressure equalization across lid 36 while a chemical reaction occurs within bores 14, 34, such as the degradation of dissolvable materials. In some embodiments, lid 36 may manufactured to comprise one or more apertures of vents (not shown) for controlled equalization of pressure across lid 36 while a chemical reaction occurs within bores 14, 34.

According to alternative embodiments, having regard to FIG. 1A, 1B, or 3A, end cap 30 may comprise at least one dissolvable or partially dissolvable element positioned within end cap bore 34, such as disc 39 (FIGS. 1A, 1B) or 39*i* (FIG. 3A). Discs 39, 39*i* may be positioned at or near uphole end 31 of end cap 30, or in any other manner such that the dissolvable element is positioned proximal to uphole end 31 of plug 10.

In some embodiments, disc(s) 39, 39*i* may be substantially circular in cross section and have an outer diameter for sealingly engaging with the inner surface of end cap bore 34. When in position, disc(s) 39, 39*i* may prevent fluid from flowing through plug 10 (and thus the annulus of the casing string) by obstructing fluid flow through bores 34, 14, 24. Outer surface 35 may form at least one annular search groove for receiving and containing at least one seal 40 (e.g., O-rings). disc(s) 39, 39*i* may be manufactured from any suitable materials known in the art and may be securely positioned within end cap 30, and between bores 34, 14, so as to temporarily prevent fluid flow therethrough. It is contemplated that dissolvable portion 38 may be manufactured from any suitable materials known in the art.

According to embodiments, lid 36 and/or disc(s) 39, 39*i* may be configured to form a temporary isolation barrier, operative to isolate an uphole fluid-filled section of the casing string (e.g., during integrity testing of the casing string) from downhole componentry. Lid 36 and/or disc(s) 39, 39*i* may be configured to remain in place for a sufficient duration of time to withstand integrity testing pressures before controllably bursting, rupturing, and/or dissolving from position to restore the internal diameter of the casing string (i.e., at or near the time that integrity testing is complete. In this manner, plug(s) 10 may be configured for use as top plugs during casing and cementing operations. For example, plug(s) may be operably configured for landing in an optionally latching with downhole equipment and, as will be described, for delivering specially engineered materials to target downhole locations.

In some embodiments, lid 36 and/or disc(s) 39, 39*i* may manufactured to comprise one or more apertures of vents 42 for controlled equalization of pressure across lid 36 and/or disc(s) 39, 39*i* while a chemical reaction occurs within bores 14, 34, 24. For example, where the at least one engineered material comprises a solid or near-solid, high chloride concentration material, such as a salt pellet, degradation of the downhole componentry may be controllably delayed, i.e., where downhole fluids within chamber 18 may become saturated. Moreover, as gasses produced from the degradation of the downhole componentry are evacuated ('burped') through vent 40, fresh fluids from above lid 36 and/or disc(s) 39, 39*i* may be drawn into chamber 18 to ensure the continued progression of the degradation reaction. In such embodiments, without limitation, it is contemplated that the higher the chloride concentration of the at least one engineered materials, the slower the degradation of the downhole componentry (due to chloride ion saturation levels within chamber 18).

As above, according to embodiments, plug(s) 10 may be configured to form at least one sealed chamber 18 for receiving, retaining, and controllably releasing a specified quantity of engineered materials at a predetermined time and/or predetermined rate, as desired. That is, plug 10 may be specifically configured to carry an engineered material and to deliver the material to a target locations downhole, such materials for enhancing the dissolution of dissolvable componentry (e.g., catalytic materials), to alter the chemical properties of wellbore fluids, or a combination thereof. In this manner, plug(s) 10, which are operable for use during casing and cementing operations may also be operable to accurately trigger the dissolution of dissolvable downhole components and to reliably establishing a flow path to the formation, while reducing the time required to mill up the downhole components.

In some embodiments, methods of loading or pre-loading a at least one engineered material into plug(s) 10 are provided. Engineered materials may be loaded into central bore 14 and at least temporarily retained in place by disc 26, lid 36, a combination thereof, or in any other suitable manner (i.e., where materials are contained within chamber 18 and the plug 10 is in a first closed-off embodiment). Once loaded, plug(s) 10 may be launched into the annulus of the casing string using any conventional means known in the art. Plug(s) having materials enclosed therein may be pumped downhole to any target locations, such locations predetermined based upon the location of dissolvable materials, and or wellbore fluids the chemistries of which are to be altered.

According to embodiments, plug(s) 10 may be configured to comprise one or more check valves, such valve(s) positioned within central bore 14 of plug body 12. For example, where chemical reactions occurring within chamber 18 are exothermic in nature and gases are generated (e.g., hydrogen gas), at least one check valve may be used to contain and manage increasing pressures within bore central 14, as appropriate.

In operation, plug(s) 10 may be loaded with at least one engineered materials specifically designed to alter the chemical properties of wellbore fluids, e.g., the salinity of the fluids, such altered chemistries serving to controllably trigger the dissolution of wellbore components downhole at predetermined rates and/or over predetermined periods of time. Plug(s) 10 may therefore initially serve to obstruct or block fluid flow through the casing string (so as to withstand integrity testing operations within the casing string) and, when desired, to subsequently and controllably release the at least one engineered materials from the plug(s) 10 (via the dissolution and disappearance of at least disc 26 and/or the removal of lid 36). Timed/delayed released of the at least one engineered materials may alter chemical properties of the downhole environment at or near the plug(s) 10 (e.g., altering salinity to dissolve downhole componentry within proximity of plug(s) 10, through diffusion of catalytic materials approximately 50-100 feet into the surrounding wellbore), while also serving to reinstate fluid flow through the casing string.

In specific operation, without limitation and by way of example, on site and as desired, downhole end 13 of plug body 12 may be threadably and sealingly engaged with nose portion 20 having disc 26 positioned within bore 24. A quantity of at least one predetermined engineered material may be loaded into bore 14 and contained therein by disc 26. Engineered materials may comprise one or more catalytic materials, such materials serving to enhance the dissolution of dissolvable componentry when exposed to water. Once loaded, end cap 30 may be threadably and sealingly engaged with uphole end 11 of plug body and lid 36 releasably secured in place to close bore 34. Plug(s) 10 may then be loaded releasably secured to end cap portion 30 and the plug 10 may be loaded into the wellbore pumping equipment for launch into the wellbore.

Once launched into the wellbore, plug(s) 10 may serve as a wiper plug where fins 16 clean cement and debris from the wellbore as plug(s) 10 travel downhole. Nose portion 20 may be specifically configured for plug(s) 10 to land in and optionally latch with downhole componentry at a target location within the wellbore (e.g., within a float shoe or toe port assembly). Once landed and securely in place, closed-off plug(s) 10 serve to isolate an uphole fluid-filled section of the casing string (e.g., during integrity testing of the casing string and/or the cement sheath). For example, plug (s) 10 can be bumped and fluid flow volumes, flow rates, and pressures may be recorded as known in the art. Testing may depend upon various casing string parameters including, without limitation, casing size, grade and weight. Advantageously, plug 10 may be configured to withstand any pressure testing operations up to at least 80-90% API burst pressures, regardless of the casing string being tested.

Over time, dissolvable portions of plug(s) 10 become exposed to wellbore fluids and begin to break down, such period of time being substantially sufficient to allow cement to cure and for integrity testing to occur). For example, disc 26 may dissolve to open nose-portion 20, such dissolution producing hydrogen gas which may dislodge lid 36 and open end cap 30. Advantageously, if desired, the delayed release of engineered materials within plug(s) 10 may serve to enhance the dissolution of dissolvable portions, may be released from the plug(s) into the surrounding wellbore environment (altering fluid chemistries, i.e., increasing salinity), or a combination thereof, the at least one engineered material mixing with wellbore fluids and assisting with establishing thereof. As would be understood, when necessary, any remaining portions of plug(s) 10 may be readily milled out from the casing string.

According to embodiments, the presently improved plug (s) 10 may be further configured to contain and deliver at least one fluid for monitoring fluid flow through the casing string, such as a tracer material. In some embodiments, such fluids may be loaded into chamber 18 alone, or in combination with the at least one engineered materials. For example, where plug(s) 10 serve release the at least one engineered materials to dissolve check valves in the shoe track, subsequent fracing operations can be performed through the shoe track, the fluid flow back of such operations being monitored at surface using the tracer materials.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

What is claimed:

1. A wiper plug for use in wiping the inner surface of a casing string positioned within a subterranean wellbore, the plug comprising:

at least one tubular body forming a longitudinal bore extending therethrough, the longitudinal bore being temporarily sealed by at least one dissolvable disc to form a chamber for receiving and containing at least one engineered material;

at least one annular wiper fin mounted to the tubular body and extending radially outwardly therefrom to engage the inner surface of the casing string, and at least one engineered material received within the at least one chamber for controllably degrading the at least one dissolvable disc, releasing the at least one engineered material into the longitudinal bore to further controllably degrade at least one dissolvable component positioned within the wellbore.

2. The wiper plug of claim 1, wherein the at least one tubular body comprises at least two tubulars forming the sealed chamber within the longitudinal bore, and wherein one of the at least two tubulars, comprises the at least one dissolvable disc.

3. The wiper plug of claim 1, wherein the at least one dissolvable disc is manufactured from a degradable metal alloy.

4. The wiper plug of claim 3, wherein the at least one engineered material comprises a catalytic material for enhancing the degradation of the at least one dissolvable disc.

5. The wiper plug of claim 1, wherein the at least one tubular body comprises at least three tubulars forming the sealed chamber within the longitudinal bore, and wherein one of the at least three tubulars further comprises at least one lid temporarily secured thereto.

6. The wiper plug of claim 5, wherein the at least one lid is manufactured from elastomeric materials, dissolvable materials, or a combination thereof.

7. The wiper plug of claim 6, wherein the at least one lid is manufactured from be manufactured from thin, solid or nearly solid, pliable synthetic materials such as a synthetic vinyl, including polyvinyl alcohol (PVA) plastic, a thermoplastic polymer, polyglycolide or poly(glycolic acid) PGA, from one or more elastomeric materials, or a combination thereof.

8. The wiper plug of claim 1, wherein the at least one wiper fin is formed from at least two fin materials.

9. The wiper plug of claim 8, wherein the at least two fin materials comprise at least one elastomeric material, at least one dissolvable material, or a combination thereof.

10. A method of delivering at least one engineered material to a target location in a casing string positioned in a subterranean wellbore, the method comprising:

providing at least one wiper plug having a body forming a longitudinal bore, the longitudinal bore forming at least one chamber for receiving and containing the at least one engineered material, and at least one dissolvable disc, loading the chamber of the at least one wiper plug with the at least one engineered material, launching the at least one wiper plug into the casing string and allowing the at least one wiper plug to wipe the casing string as the at least one wiper plug passes therethrough, landing and securing the wiper plug at or near the target location, and allowing the at least one engineered material to degrade the at least one dissolvable disc and controllably release the at least one engineered material into the wellbore, wherein the release of the at least one engineered material further controllably degrades at least one dissolvable component positioned within the wellbore.

11. The method of claim 10, wherein the at least one wiper plug further comprises at least one annular wiper fin to wipe an inner surface of the casing string.

12. The method of claim 11, wherein the wiper fin is formed from at least two materials.

13. The method of claim 12, wherein the at least two materials comprise at least one elastomeric material, at least one dissolvable material, or a combination thereof.

14. The method of claim 10, wherein the at least one engineered material is a catalytic material for enhancing the degradation of the at least one dissolvable disc.

15. The method of claim 10, wherein the release of the at least one engineered material occurs at a predetermined time and a predetermined rate.

16. The method of claim 10, wherein the release of the at least one engineered material further controllably alters the chemical properties of fluids in the wellbore.

17. The method of claim 10, wherein, prior to the release of the at least one engineered material, integrity testing of the casing string is performed.

18. The method of claim 10, wherein gases produced from the degradation of the at least one dissolvable disc is controllably vented from the at least one wiper plug.

19. The method of claim 10, wherein the at least one wiper plug is further be loaded with at least one tracer material.

* * * * *